US007771207B2

(12) United States Patent
Hamner et al.

(10) Patent No.: US 7,771,207 B2
(45) Date of Patent: Aug. 10, 2010

(54) ASSEMBLY FOR INTERCONNECTING CIRCUIT BOARDS

(75) Inventors: Richard Elof Hamner, Hummelstown, PA (US); Scott Stephen Duesterhoeft, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 131 days.

(21) Appl. No.: 12/240,646

(22) Filed: Sep. 29, 2008

(65) Prior Publication Data

US 2010/0081298 A1 Apr. 1, 2010

(51) Int. Cl.
*H01R 12/00* (2006.01)

(52) U.S. Cl. ..... 439/65; 439/377

(58) Field of Classification Search ..... 439/65, 439/377, 259–261

See application file for complete search history.

(56) References Cited

U.S. PATENT DOCUMENTS

| | | | | |
|---|---|---|---|---|
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,834,665 | A * | 5/1989 | Kreinberg et al. | 439/260 |
| 4,840,569 | A | 6/1989 | Cabourne | |
| 5,092,781 | A | 3/1992 | Casciotti et al. | |
| 5,102,342 | A | 4/1992 | Marian | |
| 5,171,154 | A | 12/1992 | Casciotti et al. | |
| 5,228,863 | A | 7/1993 | Campbell et al. | |
| 6,062,872 | A | 5/2000 | Strange et al. | |
| 6,077,090 | A | 6/2000 | Campbell et al. | |
| 6,094,358 | A * | 7/2000 | Christensen et al. | 361/785 |
| 6,411,517 | B1 | 6/2002 | Babin | |
| 6,672,878 | B2 | 1/2004 | Dean | |
| 7,297,015 | B1 | 11/2007 | Desrosiers et al. | |
| 7,374,441 | B2 * | 5/2008 | Rubenstein | 439/160 |
| 7,438,577 | B2 * | 10/2008 | Bridges et al. | 439/260 |
| 2006/0234540 | A1 * | 10/2006 | Tipley et al. | 439/260 |
| 2007/0097662 | A1 | 5/2007 | Dean | |

* cited by examiner

*Primary Examiner*—Hien Vu

(57) ABSTRACT

An electrical connector assembly that is configured to electrically couple first and second circuit boards is provided. The connector assembly includes an electrical connector that is configured to be coupled to the first circuit board. The connector includes a board mating face and an array of connector contacts. The connector contacts are configured to engage the board contacts. The connector also includes a guide assembly that is configured to be coupled to the first and second circuit boards. The guide assembly includes a guide channel and a cam member that slidably engages the guide channel such that the second circuit board is moved during a loading stage along a longitudinal direction until the board contacts are substantially aligned with the array of connector contacts. The second circuit board is also moved during a shifting stage in a direction transverse to the longitudinal direction.

18 Claims, 7 Drawing Sheets

ASSEMBLY FOR INTERCONNECTING CIRCUIT BOARDS

BACKGROUND OF THE INVENTION

The subject matter herein relates generally to interconnecting circuit boards, and more particularly, to electrical connector assemblies that are configured to electrically couple two circuit boards.

Some electrical systems, such as servers, routers, and data storage systems, utilize backplane assemblies for transmitting signals and/or power through the electrical system. Backplane assemblies typically include a backplane circuit board, a motherboard, a plurality of daughter cards and, optionally, a midplane circuit board. The assemblies also include one or more electrical connectors that are attached to the circuit board(s) for interconnecting the daughter cards to the circuit board(s) when the daughter card is inserted into the backplane assembly. Each daughter card includes a header or receptacle assembly having a mating face that is configured to connect to a mating face of the electrical connector. The header/receptacle assembly is typically positioned on or near a leading edge of the daughter card. When inserted, the mating faces of the header/receptacle assembly and the electrical connector are aligned with each other and face each other along a central axis. The daughter card is then moved in a mating direction along the central axis until the mating faces engage and mate with each other.

However, the conventional backplane assemblies afford a limited number of possible arrangements for interconnecting the daughter cards to the backplane circuit board relative to the mating direction. For example, when the header/receptacle assembly is on a surface of the daughter card and faces a direction perpendicular to the mating direction and the electrical connector is on the backplane circuit board and also faces a direction perpendicular to the mating direction, the daughter card and the backplane circuit board may not able to connect. In addition, backplane assemblies that include a midplane circuit board may affect the electrical system's cooling capabilities by, for example, limiting airflow through the system.

Accordingly, there is a need for an electrical connector assembly that may interconnect circuit boards that are oriented in an orthogonal relationship. Furthermore, there is also a need for alternative electrical connector assemblies that are capable of connecting daughter cards to a backplane circuit board of a backplane assembly.

BRIEF DESCRIPTION OF THE INVENTION

In one embodiment, an electrical connector assembly that is configured to electrically couple first and second circuit boards is provided. The connector assembly includes an electrical connector that is configured to be coupled to the first circuit board. The connector includes a board mating face and an array of connector contacts. The connector contacts are configured to engage the board contacts. The connector also includes a guide assembly that is configured to be coupled to the first and second circuit boards. The guide assembly includes a guide channel and a cam member that slidably engages the guide channel such that the second circuit board is moved during a loading stage along a longitudinal direction until the board contacts are substantially aligned with the array of connector contacts. The second circuit board is also moved during a shifting stage in a direction transverse to the longitudinal direction until the array of connector contacts engage the board contacts.

Optionally, the connector assembly may further comprise a guide rail coupled to the first circuit board. The guide rail may have a body that includes the guide channel extending therein. The cam member may be configured to couple to and extend from the secondary circuit board. Also, the cam member may include a plurality of cam members. The cam members may be configured to couple to a common edge of the second circuit board and align with each other along the edge. Furthermore, the connector may be a right-angle connector.

In another embodiment, a backplane assembly is provided. The backplane assembly includes a backplane circuit board and a plurality of electrical connector sub-assemblies. Each connector sub-assembly is configured to electrically couple a secondary circuit board to the backplane circuit board. Each secondary circuit board has board contacts provided thereon. Each connector sub-assembly includes an electrical connector that is coupled to the backplane circuit board. The connector includes a board mating face and an array of connector contacts provided thereon. The connector contacts are configured to engage the board contacts. Also, the connector sub-assembly includes a guide assembly coupled to the backplane and configured to couple the secondary circuit boards. The guide assembly extends in a longitudinal direction along the board mating face of the connector. The guide assembly includes a guide channel and a cam member that slidably engages the guide channel such that the secondary circuit board is moved during a loading stage along the longitudinal direction until the secondary circuit board contacts are substantially aligned with the array of connector contacts and during a shifting stage in a direction transverse to the longitudinal direction until the array of connector contacts engage the secondary circuit board contacts.

Optionally, the backplane assembly may also include another backplane circuit board. Each guide assembly may be configured to be coupled to both backplane circuit boards and one secondary circuit board.

DETAILED DESCRIPTION OF THE INVENTION

Figure 1:
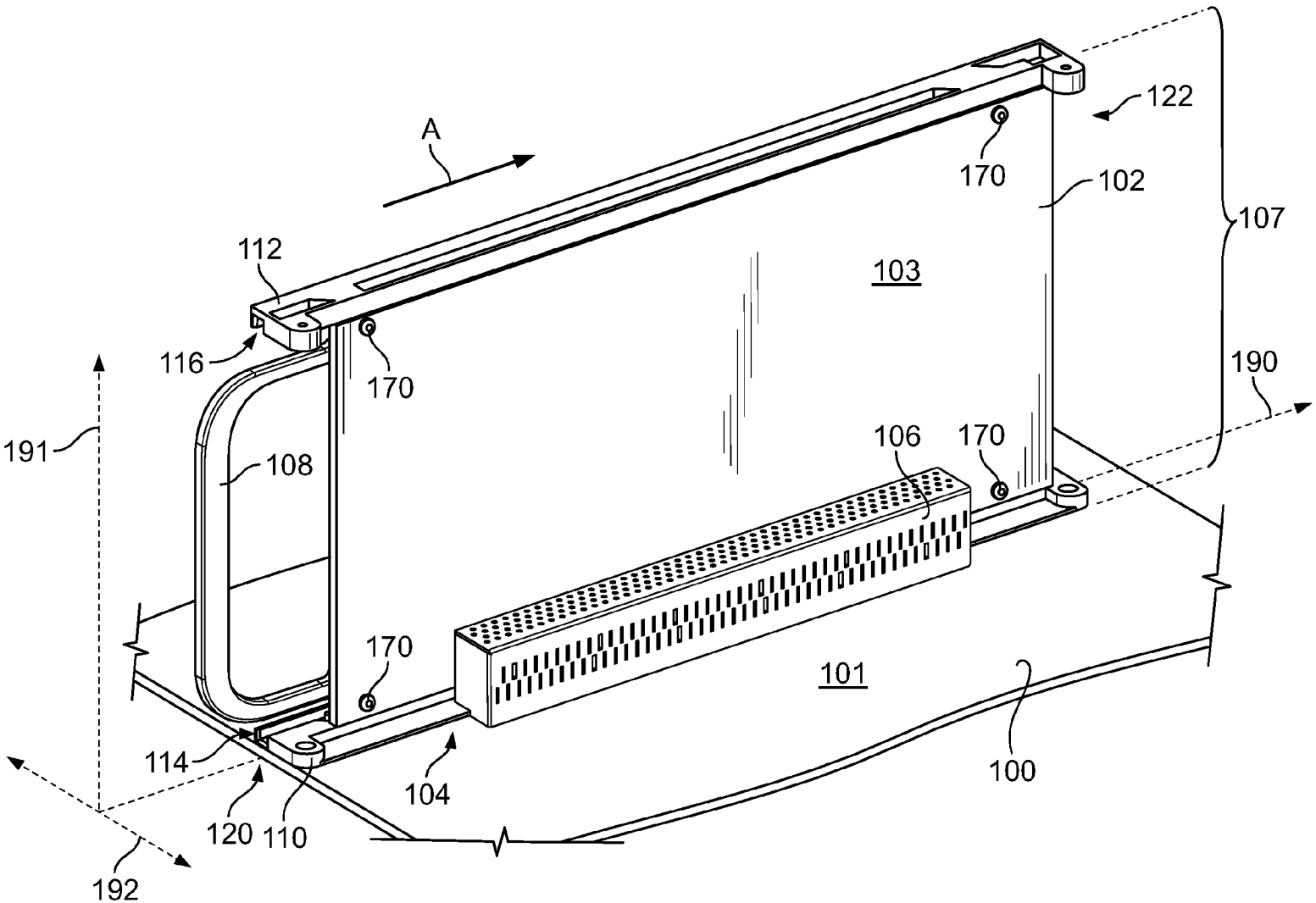
FIG. 1 is a front perspective view of primary and secondary circuit boards being coupled to one another by an electrical connector assembly formed in accordance with one embodiment.

FIG. 1 is a front perspective view of primary and secondary circuit boards 100 and 102, respectively, being electrically coupled to one another by an electrical connector assembly 104 that is formed in accordance with one embodiment. The electrical connector assembly 104 includes an electrical connector 106 that is mounted or coupled to the primary circuit board 100 and a guide assembly 107. The connector 106 has a board mating face 204 (shown in FIG. 4) that extends along a central longitudinal axis 190 and may include an array 208 of connector contacts 210 (both shown in FIG. 4). The secondary circuit board 102 has a footprint 240 of board contacts 242 (both shown in FIGS. 8 and 9) that is configured to engage or mate with the array 208 of connector contacts 210. In the illustrated embodiment, the guide assembly 107 includes a card frame 108 attached to the secondary circuit board 102 and a pair of guide rails 110 and 112 having guide channels 114 and 116, respectively. As will be discussed in greater detail below, when an insertion force (indicated by an arrow A) is applied, the guide assembly 107 is configured to move the secondary circuit board 102 during an initial loading stage substantially along the longitudinal axis 190 until the board contacts 242 are substantially aligned with the connector contacts 210. The guide assembly 107 is also configured to move the secondary circuit board 102 during a shifting stage in a direction transverse to the longitudinal direction (i.e., in a direction substantially parallel to a horizontal axis 192) until the board contacts 242 engage the connector contacts 210.

As shown, the electrical connector assembly 104 may have a front end 120 and a rear end 122. In one embodiment, the primary circuit board 100 may be a motherboard, and the secondary circuit board 102 may be a daughter card, e.g., a line or switch card, that may be removably engaged with the connector 106. The electrical connector assembly 104 may be used with a variety of host electrical systems (not shown), such as a server system, router system, or data storage system. However, although the illustrated embodiment is described with reference to interconnecting the primary and secondary circuit boards 100 and 102, the description herein is not intended to be limiting and the electrical connector assembly 104 may be used to interconnect any type of circuit boards or other electrical components where one component has an array of contacts and the other component has a matable footprint of contacts.

As shown in FIG. 1, the primary circuit board 100 includes a side or surface 101 that extends substantially parallel to or along a horizontal plane formed by the longitudinal axis 190 and the horizontal axis 192. The secondary circuit board 102 includes a mating side or surface 103 and a back side or surface 105 (shown in FIG. 3) and a substrate extending therebetween. The secondary circuit board 102 may extend substantially along or parallel to a vertical plane formed by a vertical axis 191 and the longitudinal axis 190. As such, in the exemplary embodiment, the primary circuit board 100 is substantially perpendicular to the secondary circuit board 102 such that the connector 106 interconnects the primary and secondary circuit boards 100 and 102 at a right angle to each other (i.e., the connector 106 is a right-angle connector). However, the connector 106 is not limited to being a right-angle connector and alternative embodiments may be configured to interconnect the circuit boards 100 and 102 such that the circuit boards 100 and 102 are substantially parallel to one another or such that the circuit boards 100 and 102 have a non-orthogonal relationship with one another.

Figure 2:
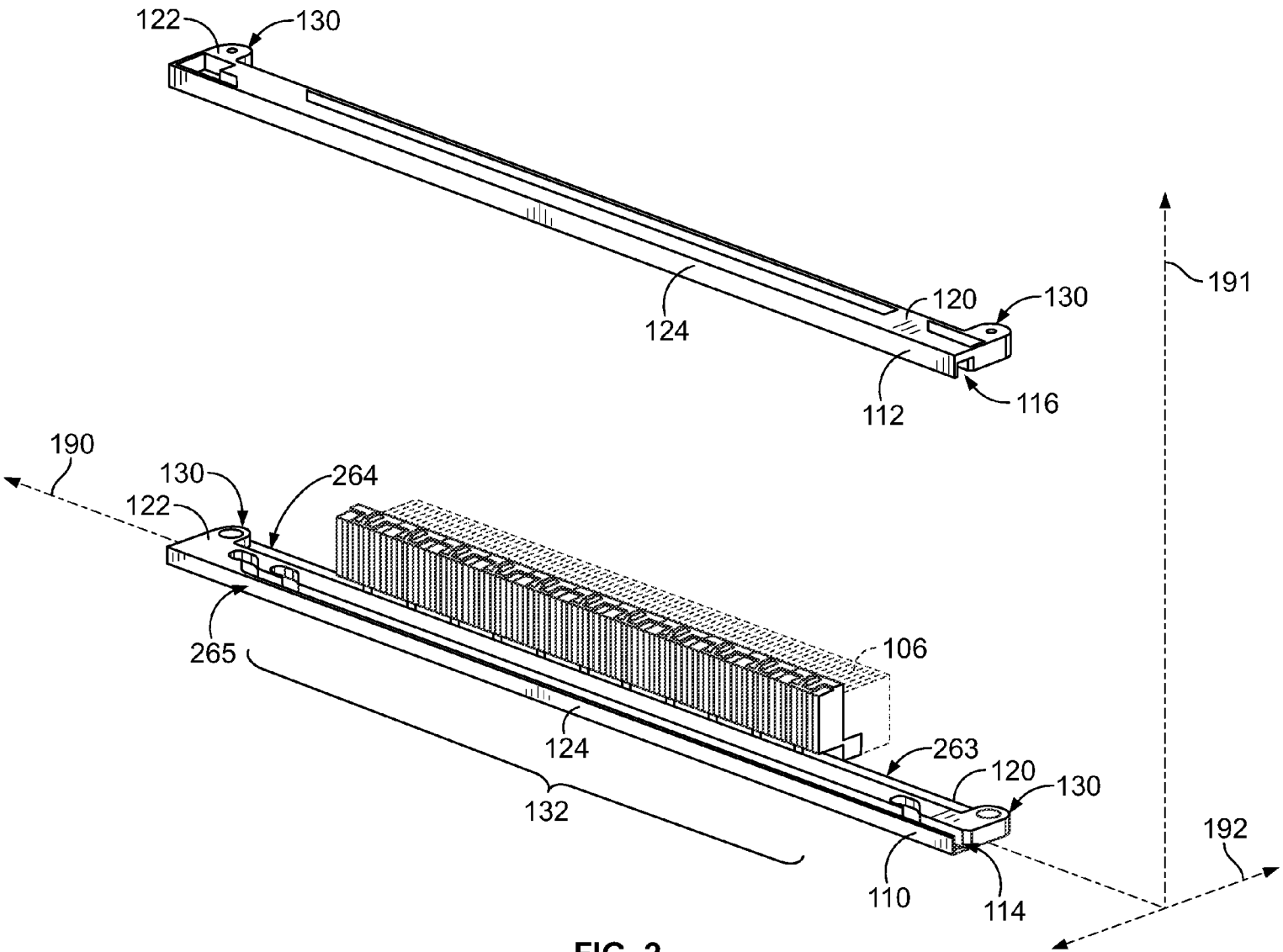
FIG. 2 is a rear perspective view of a pair of guide rails and an electrical connector used with the electrical connector assembly shown in FIG. 1.

FIG. 2 is a rear perspective view of the guide rails 110 and 112 and the connector 106 used with the electrical connector assembly 104 (FIG. 1). The guide rails 110 and 112 or, more specifically, the guide channels 114 and 116, respectively, extend in a longitudinal direction along or parallel to the longitudinal axis 190. Furthermore, in the exemplary embodiment, the guide channels 114 and 116 maybe aligned along the vertical plane formed by the axes 190 and 191. Each of the guide rails 110 and 112 has a rail body 124 that may be directly attached or affixed to a surface such that the guide channels 114 and 116 have a fixed relationship with respect to the connector 106. For example, the lower guide rail 110 may be directly attached to the primary circuit board 100 (FIG. 1) and the upper guide rail 112 may be attached to another primary circuit board (not shown) and/or some other part (e.g., panel, bezel, or chassis) of the host electrical system. As one example, the guide rails 110 and 112 may have fastener holes 130 that are positioned proximate to or at the front and rear ends 120 and 122, respectively. Alternatively, the rail bodies 124 may include or be formed with locating pins (not shown) that press fit or engage the primary circuit board 100.

In the illustrated embodiment, the guide rail 110 is positioned adjacent to the connector 106. However, in alternative embodiments, the guide rail 110 may be integrated with the connector 106. Furthermore, in embodiments in which the guide rail 112 is attached to another primary circuit board, another electrical connector, similar to the connector 106, may be positioned adjacent to the guide rail 112. In such an embodiment, the electrical connector assembly 104 may utilize a higher total amount of contacts.

The rail bodies 124 of the guide rails 110 and 112 may include the guide channels 114 and 116, respectively, extending substantially longitudinally therethrough. In one embodiment, a path of each guide channel 114 and 116 mirrors or copies the other path such that the secondary circuit board 102 maintains a vertical orientation as the secondary circuit board 102 is inserted into the electrical connector assembly 104. As shown with respect to the guide rail 110, the guide channels 114 and 116 may include longitudinal portions 132 that extend a substantial length of the corresponding guide rail and lateral portions 263-265 that extend outward from the longitudinal portion 132 in a lateral direction toward the connector 106. As will be discussed in more detail below, the paths of the guide channels 114 and 116 are configured to properly position and orient the secondary circuit board 102 with respect to the connector 106.

In an alternative embodiment, the guide rails 110 and 112 are not separate parts but are coupled to each other or are parts of a common guideframe. For example, the guide rails 110 and 112 may be coupled to each other via vertical beams that extend between the rear ends 122 and/or between the front ends 120. In such an embodiment, one or both of the guide rails 110 and 112 may be attached to a primary circuit board. Furthermore, the guideframe could be coupled to another part of the host electrical system, such as a panel or bezel.

Figure 3:
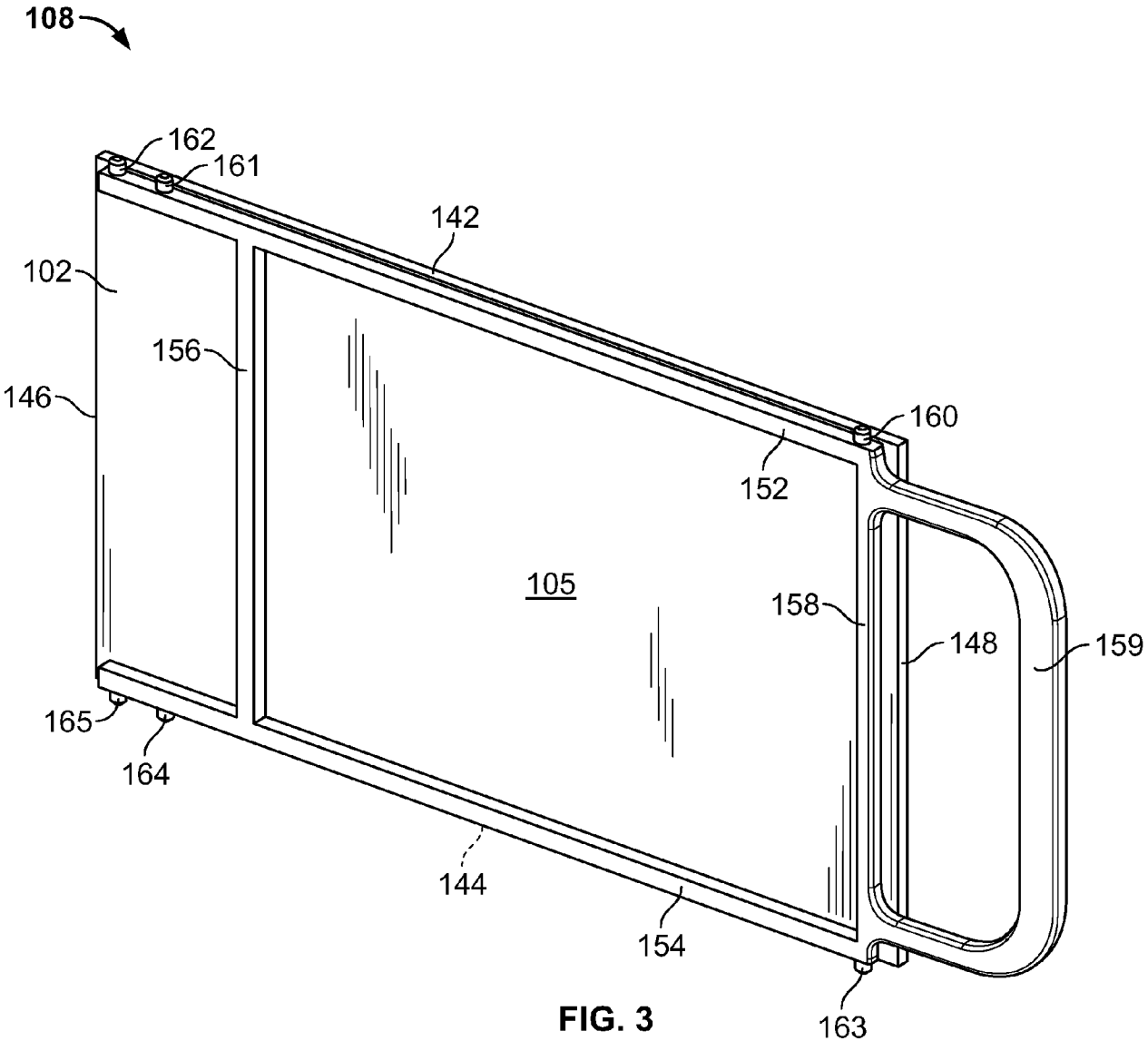
FIG. 3 is a rear perspective view of a card frame that may be used with the electrical connector assembly shown in FIG. 1.

FIG. 3 is a rear perspective view of the card frame 108 that may be used with the guide assembly 107 (FIG. 1). The card frame 108 is configured to couple to the secondary circuit board 102 along the back surface 105 and provide sufficient structural support while the secondary circuit board 102 is inserted into guide rails 110 and 112 (both shown in FIG. 1). As shown, the secondary circuit board 102 has a substantially rectangular shape and includes a pair of longitudinal edges 142 and 144 that extend parallel to each other and the longitudinal axis 190 (FIG. 1) and a pair of vertical edges 146 and 148 that extend parallel to each other and the vertical axis 191 (FIG. 1). The card frame 108 may include a pair of beams 152 and 154 that extend along adjacent to the edges 142 and 144, respectively, and a pair of cross supports 156 and 158 that extend between the pair of beams 152 and 154. As shown, the support 158 extends between the beams 152 and 154 proximate to the vertical edge 148 and the support 156 extends between the beams 152 and 154 toward the vertical edge 146. Also shown, the card frame 108 may have a handle 159 for facilitating the insertion or removal of the secondary circuit board 102 by an operator or machine.

However, FIG. 3 illustrates only an exemplary embodiment of the secondary circuit board 102 and the card frame 108. The secondary circuit board 102 and the card frame 108 may have other shapes. Furthermore, the card frame 108 may have other structural configurations along the back surface 105 such as where the supports 156 and 158 extend diagonally across and intersect each other at or near a point in the middle. In addition, the card frame 108 may have beams or supports that extend along the mating surface 103 (shown in FIG. 1).

The card frame 108 may be directly coupled to the back surface 105 of the secondary circuit board 102 using a variety of attachment mechanisms. For example, the secondary circuit board 102 may be mounted to the card frame 108 using screws 170 (shown in FIG. 1). In addition, the secondary circuit board 102 may be bonded to a surface of the card frame 108 using an adhesive or the secondary circuit board 102 may be held using clips, pins, and the like.

As shown, the beams 152 and 154 include a plurality of cam members 160-165. More specifically, the beam 152 includes cam members 160-162, and the beam 154 includes cam members 163-165. In the illustrated embodiment, the cam members 160-162 are aligned with respect to each other along the beam 152 such that the cam members 160-162 are co-planar and project away from the edge 142. Likewise, the cam members 163-165 are aligned with respect to each other along the beam 154 such that the cam members 163-165 are co-planar and project away from the edge 144. In the exemplary embodiment, the cam members 160-162 and the cam members 163-165 all extend along a common plane. Alternatively, the beams 152 and 154 may have a width that allows the cam members 160-165 to not be aligned with respect to each other. In such an embodiment, the guide rails 110 and 112 would have more than one guide channel in order to accommodate the staggered or non-aligned relationship of the corresponding cam members.

In one alternative embodiment, the electrical connector assembly 104 may not use a card frame 108. In such embodiments, the cam members 160-165 may be separately and directly coupled to the secondary circuit board 102. In addition, two or more of the cam members 160-165 may be coupled to a common beam along an edge, e.g., the cam members 160-162 coupled with each other along the edge 142. As another example, the cam members 162 and 165 may be coupled to each other by a beam that extends across a height of the secondary circuit board 102. As such, the cam members 160-165 may be separately attached to the secondary circuit board 102 and, optionally, to each other.

In another alternative embodiment, the guide assembly 107 may include a card frame 108 having guide rails that are attached to the secondary circuit board 102 and cam members or other features that are attached to or project from the primary circuit board 100. For example, when the secondary circuit board 102 is inserted into a backplane assembly the cam members or other features on the primary circuit board 100 may interact with the guide rails and direct the secondary circuit board 102 to a mated position. As such, the description of the guide assembly 107 is not intended to be limited to embodiments where the guide rails 110 and 112 are attached to primary circuit boards and where the cam members 160-165 are attached to the secondary circuit board 102, but may include, for example, other embodiments where the guide rails are attached to the secondary circuit board 102 or the card frame 108 and the cam members are attached to the primary circuit board 100.

Figure 4:
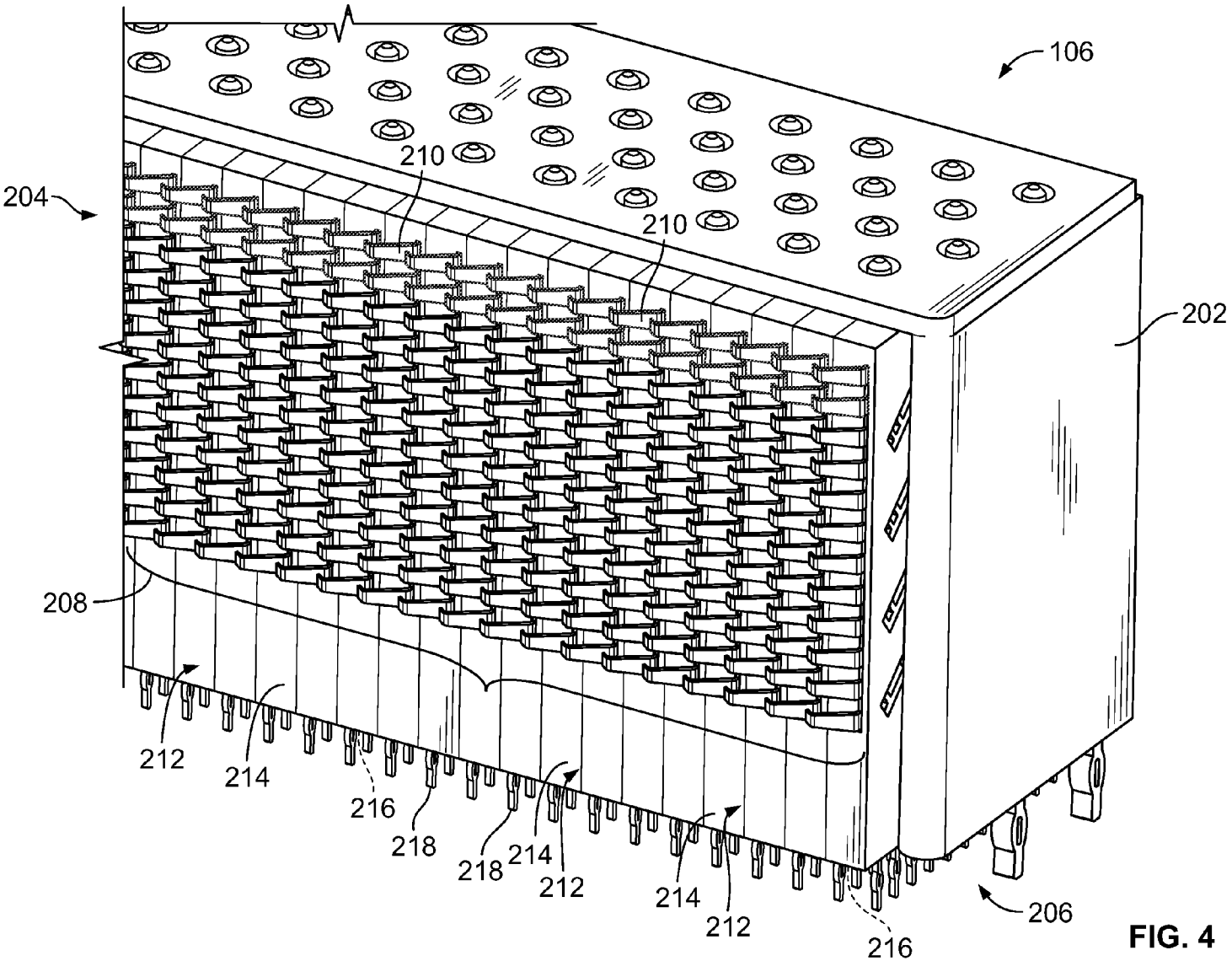
FIG. 4 is an enlarged perspective view of the electrical connector shown in FIG. 2.

FIG. 4 is an enlarged perspective view of the connector 106. The connector 106 includes a connector shield 202 and has the board mating face 204 and a mounting face 206. The board mating face 204 may include an array 208 of connector contacts 210 projecting therefrom. The connector contacts 210 are configured to interface with the footprint 240 of board contacts 242 (shown in FIGS. 8 and 9). The connector shield 202 receives and is configured to hold a plurality of chiclets or contact modules 212. The contact modules 212 hold contacts and conductive paths that electrically couple the secondary circuit board 102 (FIG. 1) to the primary circuit board 100 (FIG. 1) when the secondary circuit board 102 is in a fully mated position. Each contact module 212 includes a contact lead frame (not shown) that is insert molded or otherwise encased in a contact module housing 214 fabricated from a dielectric material. The module housing 214 has a mounting edge 216 configured for mounting to the surface 101 (FIG. 1) of the primary circuit board 100. Each contact module 212 includes a plurality of contact tails 218 that extend from the lead frame within the contact module 212 and extend through the mounting edge 216 of the module housing 214 for attaching to, for e.g., through-holes along the surface 101 the primary circuit board 100.

The contact lead frame includes a plurality of conductive contacts terminating at one end with the connector contacts 210 and terminating at another end with the contact tails 218. Each contact module 212 may include signal contacts and ground contacts arranged in a predetermined pattern. For example, the pattern may include pairs of signal contacts and individual ground contacts arranged in an alternating sequence. Furthermore, when transmitting differential signals it may be desired that the lengths of the signal paths for the signal pair be as closely matched as possible so as to minimize skew in the transmitted signal. However, alternative embodiments may have a predetermined amount of skew.

As shown, the connector contacts 210 project outward from the board mating face 204 and may be bent or biased toward one end. As will be discussed in greater detail below, the connector contacts 210 may have resilient bodies that are configured to engage a corresponding board contact 242 of the footprint 240 when the secondary circuit board 102 is moved into the mating position and flex inward toward the board mating face 204. The connector contacts 210 may also resist or slightly resile outward creating a resistance force F (shown in FIG. 9) against the footprint 240.

Although the array 208 of connector contacts 210 are shown as projecting outward from the board mating face 204, in alternative embodiments, the connector 106 may include a plurality of contact channels (not shown) where each contact channel leads to a corresponding contact 210. The contact channels may be configured to received contact projections or tails from the secondary circuit board 102. In such an embodiment, the contacts may not be biased or only slightly biased. In another alternative embodiment, the connector contacts 210 have a similar configuration as the board contacts 242 (i.e., the connector contacts 210 may be contact pads).

Figure 5:
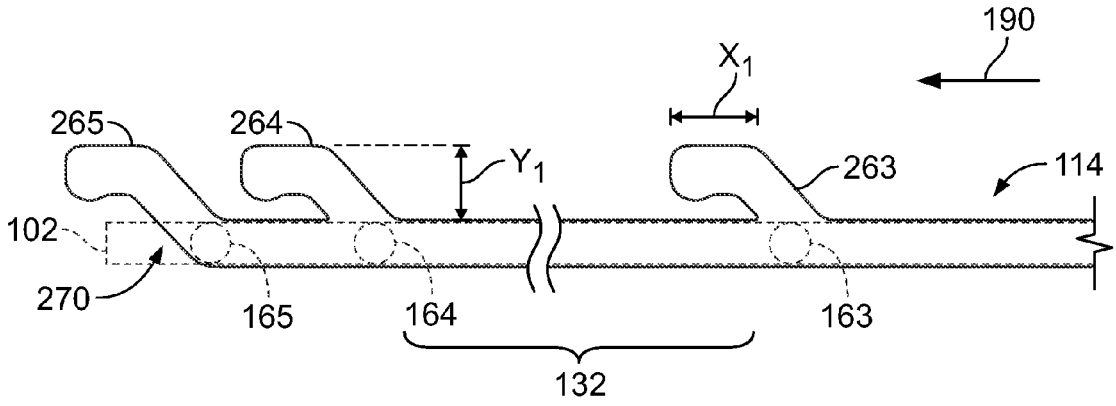
FIG. 5 is a top planar view of a guide channel that may be used with the card Frame shown in FIG. 3 and shows cam members in a first position along the guide channel.
Figure 6:
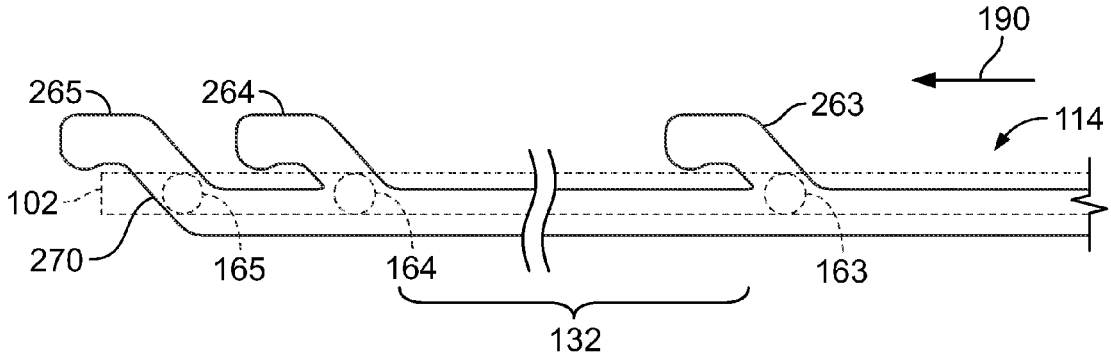
FIG. 6 is the view shown in FIG. 5 illustrating the cam members in a second position.
Figure 7:
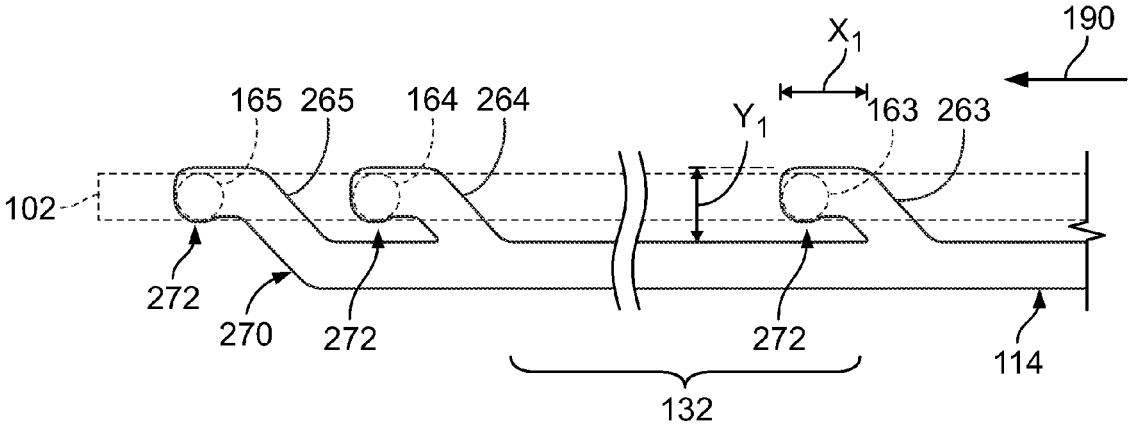
FIG. 7 is the view shown in FIG. 5 illustrating the cam members in a third position.

FIGS. 5-7 are top planar views of the guide channel 114 illustrating movement of cam members 163-165 while in the guide channel 114. As shown, the cam members 163-165 and the secondary circuit board 102 are indicated by dashed lines. The longitudinal portion 132 may extend in a direction that is substantially parallel to the longitudinal axis 190. (For illustrative purposes, a section of the longitudinal portion 132 has been removed in FIGS. 5-7.) Although FIGS. 2 and 5-7 illustrate the longitudinal portion 132 being substantially linear, the longitudinal portion 132 may have a path that does not extend linear from the front end 120 (FIG. 1) to the rear end 122 (FIG. 1) but slightly veers or shifts as the guide channels 114 extend along the longitudinal axis 190. Furthermore, in one embodiment, the longitudinal portion 132 may be slightly angled toward the board mating face 204 (FIG. 4) of the connector 106 (FIG. 4) as the longitudinal portions 132 extends from the front end 120 to the rear end 122. Also shown, the guide channels 114 may include lateral portions 263-265 that are configured to shift the secondary circuit board 102 toward the connector 106 as will be described in further detail below.

FIG. 5 illustrates the cam members 163-165 when the secondary circuit board 102 is in a first or substantially aligned position with respect to the connector 106. FIG. 6 illustrates the cam members 163-165 in a second or intermediate position, and FIG. 7 illustrates the cam members 163-165 in a third or fully mated position. When the cam members 163-165 are loaded into the guide channel 114 and are moved toward the rear end 122, the cam members 163-165 and the secondary circuit board 102 are in a loading stage. In the loading stage, the cam member 165 moves from the front end 120 of the guide channel 114 to a path end 270 of the guide channel 114. As such, the cam members 163-165 may travel a substantial length along the longitudinal axis 190 to the substantially aligned position. In the substantially aligned position, the cam member 165 is engaged with or proximate to the path end 270. The path end 270 is configured to direct the cam member 165 into the corresponding lateral portion 265. Consequently, the cam members 164 and 163 are also directed into corresponding lateral portions 264 and 263.

As shown in FIG. 6, dimensions of the cam members 163-165 and the guide channel 114 may cause a slight lagging of the cam members 164 and 165 with respect to the cam member 163. More specifically, when the cam member 165 engages the path end 270, the insertion force may cause the cam member 165 to enter the lateral portion 265 and move toward the connector 106 before the other cam members 163 and 164 enter the lateral portions 263 and 264, respectively.

When the cam members 165 begins to shift toward the connector 106, the cam members 163-165 and the secondary circuit board 102 are in a shifting stage of the guide channel 114. In the shifting stage, the lateral portions 263-265 are configured to move the cam members 163-165 from the substantially aligned position to the fully mated position. As such, the secondary circuit board 102 moves in a direction that is transverse to the longitudinal axis 190. As shown in FIGS. 5 and 7, the secondary circuit board 102 and the cam members 163-165 move a longitudinal distance $X_1$ and a horizontal distance $Y_1$. The distances $X_1$ and $Y_1$ are configured such that the footprint 240 of board contacts 242 (FIGS. 8 and 9) on the secondary circuit board 102 engages and electrically couples with the array 208 of connector contacts 210 from the connector 106.

Also shown in FIG. 7, the lateral portions 263-265 may include cam grooves 272 placed at an end of the corresponding lateral portion 263-265. Each cam groove 272 is configured to hold the corresponding cam member when the secondary circuit board 102 is in the fully mated position. The cam grooves 272 are shaped or indented in order to resist or prevent the cam members 163-165 from inadvertently moving out of the fully mated position.

Figure 8:
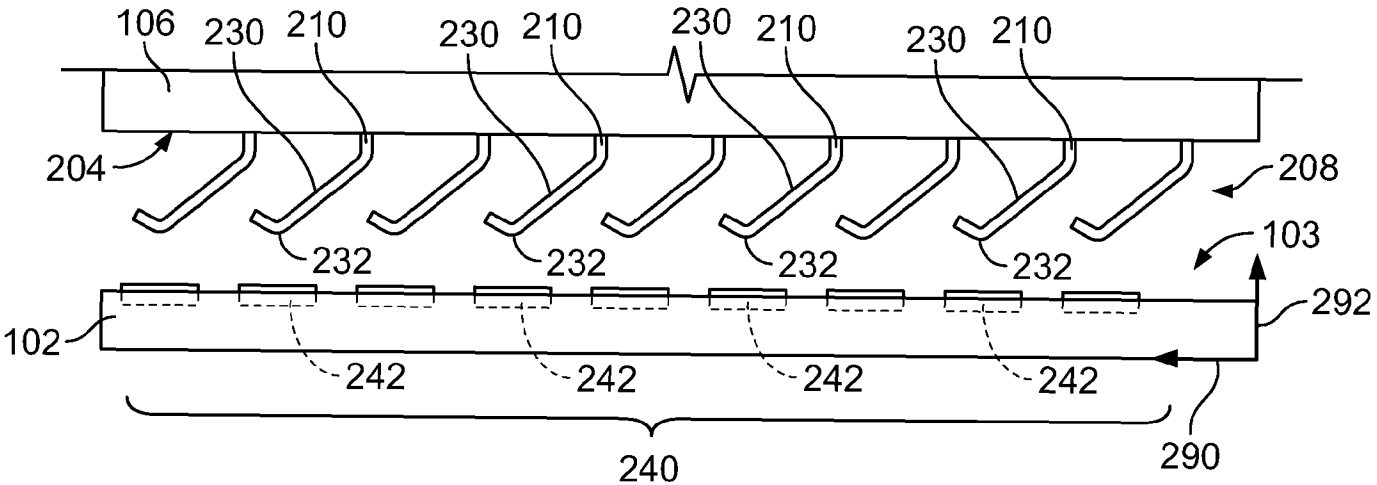
FIG. 8 is a top cross-sectional view of the secondary circuit board when in the first position.
Figure 9:
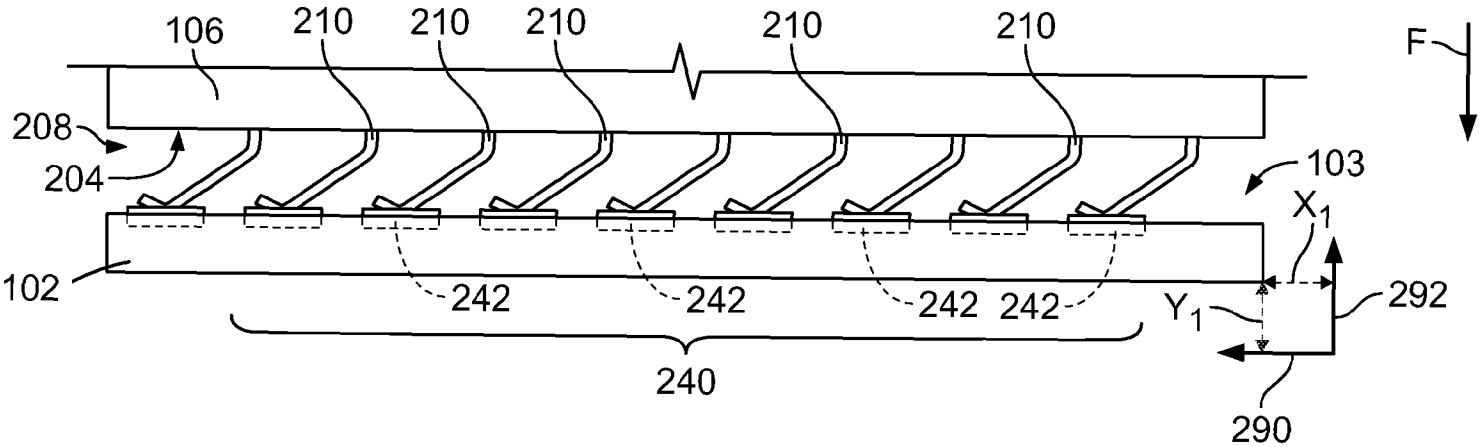
FIG. 9 is the view shown in FIG. 7 when the secondary circuit board is in the third position.

FIGS. 8 and 9 are top cross-sectional views of a portion of the array 208 of connector contacts 210 before and after the array 208 engages the footprint 240 of board contacts 242. FIG. 8 illustrates when the secondary circuit board 102 is in the substantially aligned position with respect to the connector 106. FIG. 9 illustrates when the secondary circuit board 102 has shifted from the substantially aligned position to the fully mated position. As shown, the array 208 of the connector contacts 210 project outward from the board mating face 204 of the connector 106. The connector contacts 210 may be formed to include resilient bodies that may flex away and toward the board mating face 204. For example, the connector contacts 210 may include beams 230 that project outward from the board mating face 204 toward the secondary circuit board 102 and form distal end portions 232. The end portions 232 are configured to engage or mate with a corresponding board contact 242.

In the illustrated embodiment, the beams 230 project at a non-orthogonal angle with respect to mating face 204. When the secondary circuit board 102 moves during the shifting stage, the board contacts 242 move toward and engage the connector contacts 210. In such embodiments that include angled beams 230, the connector contacts 210 flex inward toward the board mating face 204. The connector contacts 210 may be configured to resist or slightly resile outward from the board mating face 204. As described above, when the secondary circuit board 102 has moved into the fully mated position, the cam members 163-165 (shown in FIGS. 5-7) may be positioned within cam grooves 272 (shown in FIG. 7). In one embodiment, the connector contacts 210 create a resistive force F that is directed toward the secondary circuit board 102. The resistive force F may facilitate maintaining the secondary circuit board 102 in the fully mated position.

As shown with reference to axes 290 and 292, when the secondary circuit board 102 moves from the substantially aligned position to the fully mated position the secondary circuit board 102 moves the horizontal distance $X_1$ and the longitudinal distance $Y_1$. The distances $X_1$ and $Y_1$ are configured such that when the secondary circuit board 102 is in the fully mated position, the board contacts 242 on the secondary circuit board 102 engage and electrically couple with corresponding connector contacts 210 of the connector 106.

In the illustrated embodiment, the board contacts 242 are contact pads that are substantially flush or project slightly from the surface 103 of the secondary circuit board 102. However, the board contacts 242 are not required to be substantially flush, but may be disposed within corresponding cavities or may project substantially outward from the surface 103.

Also, the board contacts 242 are not required to be pads and may take other shapes in alternative embodiments. For example, a separate connector, which may be similar to the connector 106, may be affixed to the circuit board 102 and include the board contacts 242 extending therefrom. The board contacts 242 may have a similar shape as the connector contacts 210 and include beams and curved distal end portions.

Figure 10:
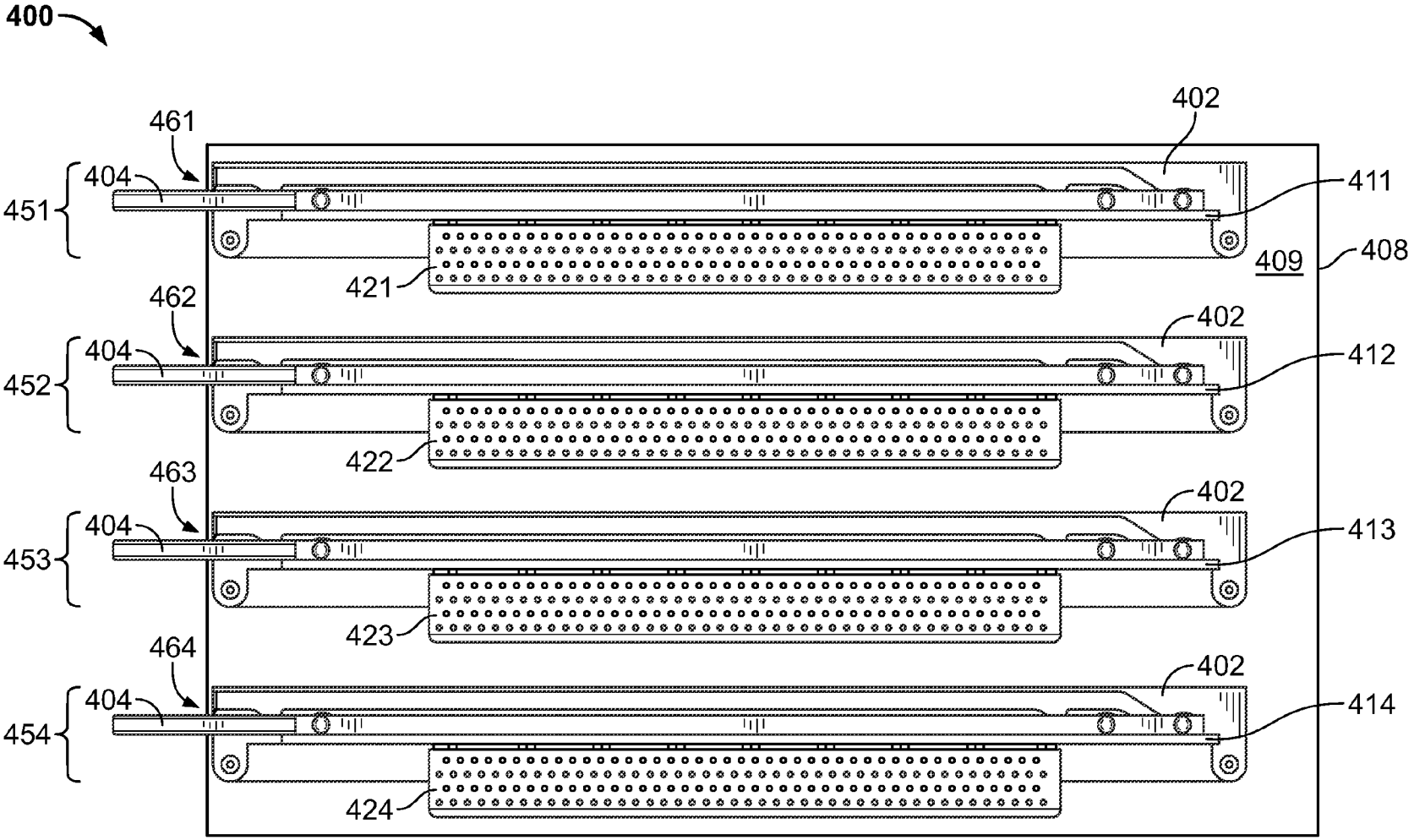
FIG. 10 is a top planar view of a server assembly formed in accordance with one embodiment.

FIG. 10 is a top planar view of a sever assembly 400 formed in accordance with one embodiment. The sever assembly 400 may be used with a host electrical system, such as a server system, router system, or a data storage system. As shown, the sever assembly 400 includes a main circuit board 408 having a surface 409. The sever assembly 400 may include a plurality of electrical connector sub-assemblies 451-454 having similar components and parts as described above with respect to the electrical connector assembly 104 (FIG. 1). More specifically, each connector sub-assembly 451-454 may include a corresponding guide assembly 461-464 and an electrical connector 421-424. As shown, the electrical connector 421-424 has a fixed position with respect to a guide rail 402 that includes at least one guide channel (not shown). The guide sub-assemblies 461-464 may include card frames 404 that are configured to hold one of a plurality of secondary circuit boards 411-414. The guide rails 402 are configured to engage card frames 404 so that the secondary circuit boards 411-414 may move along the guide rails 402 and engage the corresponding connector 421-424, respectively. The secondary circuit boards 411-414 are shown in the third position in FIG. 10.

Thus, it is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly configured to electrically couple first and second circuit boards, the second circuit board having board contacts provided thereon, the connector assembly comprising:

an electrical connector configured to be coupled to the first circuit board, the connector including a board mating face and an array of connector contacts provided thereon, the connector contacts being configured to engage the board contacts; and a guide assembly configured to be coupled to the first and second circuit boards and positioned to extend in a longitudinal direction along the board mating face of the connector, the guide assembly including a guide rail coupled to the first circuit board, the guide rail having a body including a guide channel extending along the guide rail, and cam members coupled to and extending from the second circuit board, the cam members slidably engaging the guide channel such that the second circuit board is moved during a loading stage along the longitudinal direction until the board contacts are substantially aligned with the array of connector contacts and during a shifting stage in a direction transverse to the longitudinal direction until the array of connector contacts engage the board contacts.

2. A connector assembly in accordance with claim 1 wherein the connector is a right-angle connector.

3. A connector assembly in accordance with claim 1 wherein the guide rail is a first guide rail and the guide channel is a first guide channel, the connector assembly further comprising a second guide rail having a second guide channel, the second circuit board slidably engaged with the first and second guide channels.

4. A connector assembly in accordance with claim 1 wherein the cam members are aligned with each other along an edge of the second circuit board.

5. A connector assembly in accordance with claim 1 wherein the guide channel and the cam members are configured such that the second circuit board is substantially perpendicular to the first circuit board.

6. A connector assembly in accordance with claim 1 wherein the guide channel includes cam grooves positioned at an end of the guide channel, the cam members being held within the cam grooves when the board contacts are engaged with the connector contacts.

7. A connector assembly in accordance with claim 1 wherein the connector contacts include beams projecting from the board mating face to a distal end portion, the beams biased in a direction that is non-orthogonal with respect to the board mating face.

8. A connector assembly in accordance with claim 7 wherein the end portions of the connector contacts are configured to engage and resile against the board contacts.

9. A connector assembly in accordance with claim 1 wherein the first circuit board is a motherboard and the second circuit board is a daughter card.

10. A server assembly comprising:

a primary circuit board;

a plurality of electrical connector sub-assemblies, each connector sub-assembly configured to electrically couple a secondary circuit board to the primary circuit board, wherein each secondary circuit board has board contacts provided thereon, each connector sub-assembly comprising:

an electrical connector coupled to the primary circuit board, the connector including a board mating face and an array of connector contacts provided thereon, the connector contacts being configured to engage the board contacts; and a guide assembly coupled to the primary circuit board and configured to couple the secondary circuit board, the guide assembly extending in a longitudinal direction along the board mating face of the connector, the guide assembly including a guide rail coupled to the primary circuit board, the guide rail having a body including a guide channel extending along the guide rail, and cam members coupled to and extending from the secondary circuit board, the cam members slidably engaging the guide channel such that the secondary circuit board is moved during a loading stage along the longitudinal direction until the board contacts are substantially aligned with the array of connector contacts and during a shifting stage in a direction transverse to the longitudinal direction until the array of connector contacts engage the board contacts.

11. A server assembly in accordance with claim 10 wherein the connector is a right-angle connector.

12. A server assembly in accordance with claim 10 wherein the guide rail is a first guide rail and the guide channel is a first guide channel, the connector sub-assembly further comprising a second guide rail having a second guide channel, the secondary circuit board slidably engaged with the first and second guide channels.

13. A server assembly in accordance with claim 10 wherein the cam members are aligned with each other along an edge of the secondary circuit board.

14. A server assembly in accordance with claim 10 wherein the guide channel and the cam members are configured such that the secondary circuit board is substantially perpendicular to the primary circuit board.

15. A server assembly in accordance with claim 10 wherein the guide channel includes cam grooves positioned at an end of the guide channel, the cam members being held within the cam grooves when the board contacts are engaged with the connector contacts.

16. A server assembly in accordance with claim 10 wherein the connector contacts include beams projecting from the board mating face to a distal end portion, the beams biased in a direction that is non-orthogonal with respect to the board mating face.

17. A server assembly in accordance with claim 16 wherein the end portions of the connector contacts are configured to engage and resile against the board contacts.

18. A server assembly in accordance with claim 10 wherein the primary circuit board is a first primary circuit board, the backplane assembly further comprising a second primary circuit board, each guide assembly configured to be coupled to the first and second primary circuit boards and one secondary circuit board.

* * * * *